United States Patent [19]

Zembrzuski

[11] 4,026,350

[45] May 31, 1977

[54] BUILT IN DE-ICING DEVICE

[76] Inventor: Sigmond Zembrzuski, 1419 Madison Ave., South Milwaukee, Wis. 53172

[22] Filed: June 19, 1975

[21] Appl. No.: 588,487

[52] U.S. Cl. ..... 165/46; 126/271.1; 165/104 R; 404/17; 404/71

[51] Int. Cl.[2] ..... F28F 7/00

[58] Field of Search ..... 165/46, 104; 126/271.1; 404/17, 27, 71, 79

[56] References Cited

UNITED STATES PATENTS

| | | | |
|---|---|---|---|
| 1,349,136 | 8/1920 | Lillard | 165/46 |
| 2,408,605 | 10/1946 | Brookes | 165/52 |
| 2,505,622 | 4/1950 | McKee | 404/17 |
| 2,515,341 | 7/1950 | Giguere | 126/271.1 |
| 2,634,659 | 4/1953 | Jordanoff | 404/71 |
| 3,151,613 | 10/1964 | Howard | 126/271.1 |
| 3,189,021 | 6/1965 | Giguere | 126/271.1 |
| 3,680,449 | 8/1972 | Guritz | 404/17 |
| 3,683,152 | 8/1972 | Laing | 165/104 |

*Primary Examiner*—C. J. Husar
*Assistant Examiner*—Daniel J. O'Connor

[57] ABSTRACT

A device that is placed under the driveway surface and used in conjunction with a motor vehicle exhaust system to maintain an ice free driveway.

2 Claims, 2 Drawing Figures

BUILT IN DE-ICING DEVICE

BACKGROUND OF THE INVENTION

This invention relates to a device that is permanently set under the driveway foundation to provide for an ice free surface. More particularly, the invention relates to a device that is preferably used in conjunction with a motor vehicle exhaust system.

This invention substantially reduces the need to manually remove snow and ice from the driveway surface.

The prior art teaches a variety of devices that are adapted to hasten the melting of snow. For example, U.S. Pat. Nos: 1,349,136; 2,515,341; 3,151,613; 3,189,021; 3,683,152; and others.

These devices are different, however, in that they either can only melt the snow at a relatively limited area and still require manual manipulation, or do not function in conjunction with a motor vehicle exhaust system.

SUMMARY OF THE INVENTION

It is accordingly an object of the instant invention to avoid one or more drawbacks of the prior art.

It is another object of the invention to provide for a permanent de-icing apparatus to preferably be used in conjunction with motor vehicle exhaust systems.

These and other objects of the invention will become more apparent from the following detailed disclosure and claims and by reference to the accompanying drawings, in which:

FIG. 1 is a front elevational view partially exploded, showing the device installed in the working position; and FIG. 2 is a top plan view in perspective of the driveway with the device in place.

Broadly speaking, the instant invention includes the provision of a support surface de-icing apparatus especially adapted for use in conjunction with a motor vehicle comprising an elongated hollow conduit substantially imbedded under the surface and having first and second ends, exterior the surface and adapted to receive and permit the flow of a fluid therethrough, a first flexible conduit member open at both ends, one end communicating with the first end of the elongated conduit, the other end of the flexible conduit communicating with a source of heat exchangeable fluid, the second end of the elongated conduit communicating with and venting the fluid to the atmosphere whereby the passage of the fluid from the fluid source through the conduit and to the atmosphere is adapted to sufficiently raise the surface temperature of the support to effectuate ice melting.

DETAILED DESCRIPTION

Figure 1:
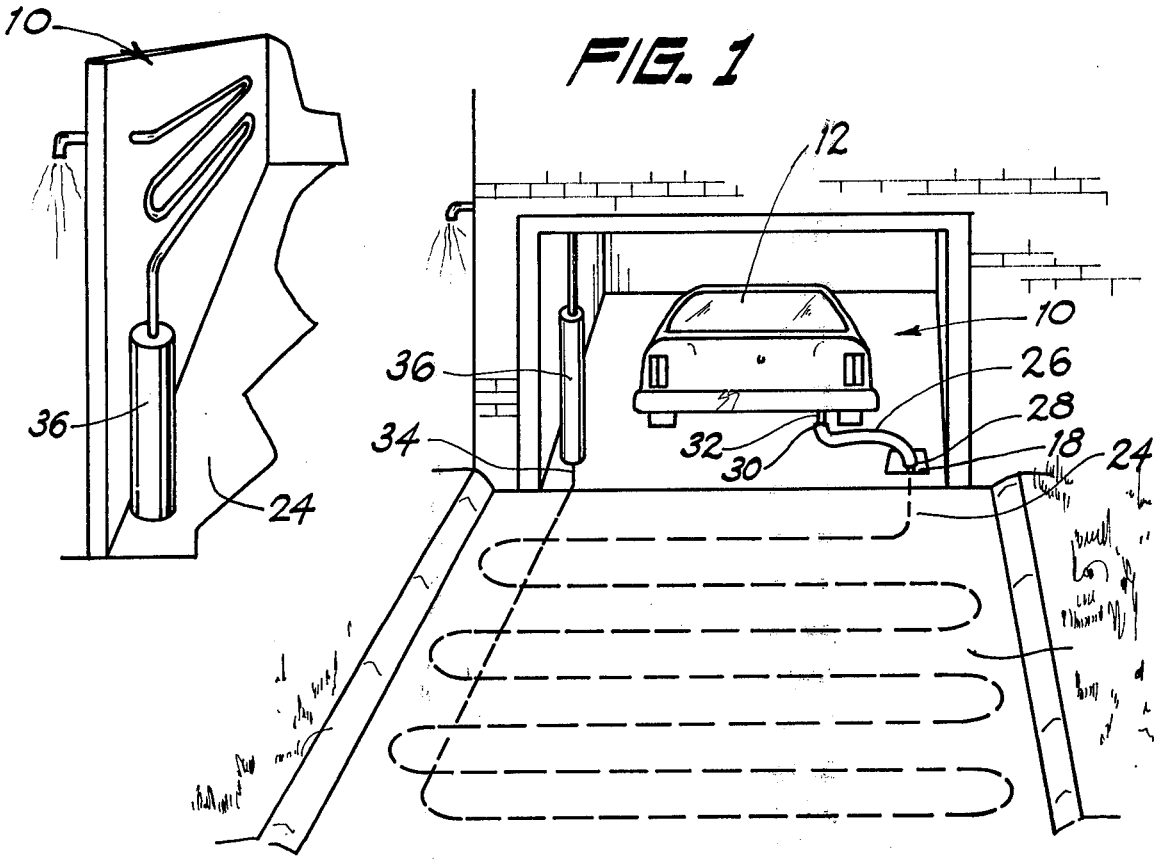
Figure 2:
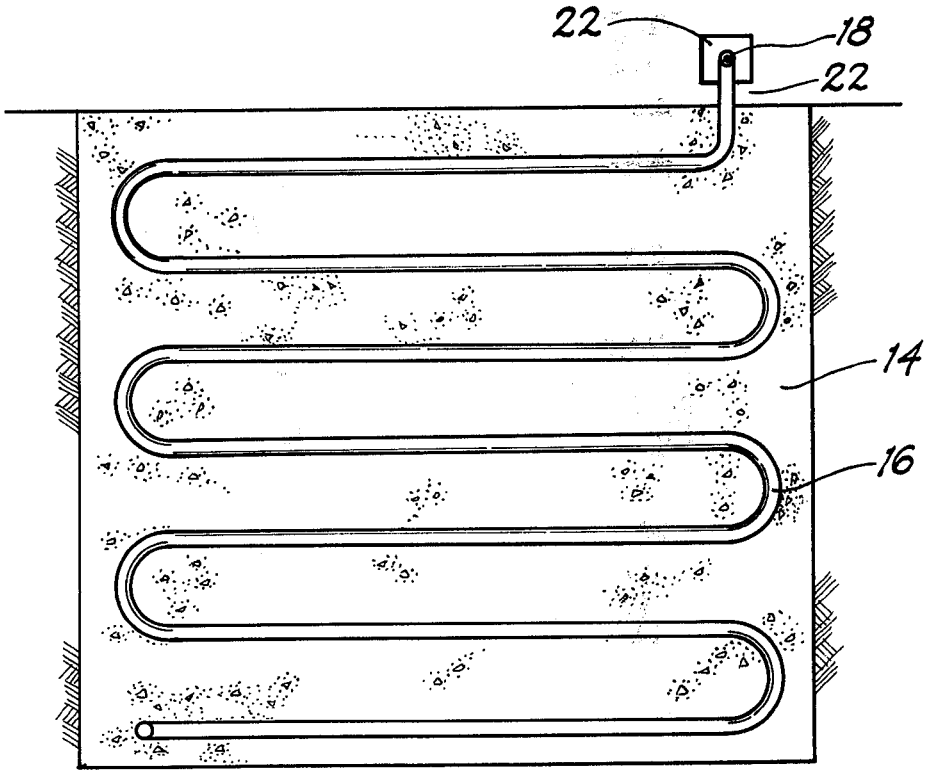

Referring more particularly to the drawings, there is shown a garage 10 having a motor vehicle 12 therein. Adjacent the garage 10 there is a driveway 14 having a substantially rigid support surface. Imbedded under the surface of the driveway 14 there is disposed an elongated hollow conduit 16 open at each end and adapted to accommodate the flow of a fluid therethrough, such as exhaust gases from the motor vehicle 10, or in certain embodiments hot water or the like said open ends being exterior said surface. The conduit 16 is essentially a heat exchanger and placed such that maximum surface area is utilized. In the preferred embodiment the same is coiled or looped from one lateral end of the driveway to the other and again, etc. Both open ends 18, 20 of the conduit 16 are disposed at least adjacent the garage 10, and preferably within the garage 10. In the preferred embodiment a first open end 18 of the conduit 16 is disposed at least in communication with a hole or cut away portion 22 of the garage floor 24 or driveway surface 14 such that the end 18 is accessible at the hole 22. If desired, the same may be recessed in the hole 22 or the conduit 16 may exit therethrough such that the end 18 is at least proximate the hole 22. The conduit 16 itself is preferably made of a heat radiating material such as steel, aluminum, copper, etc. In communication with the conduit 16 by virtue of end 18 there will be a flexible length of tubing 26, such as flexible metal, rubber, etc. The tubing is a hollow walled member, open at both ends. A first end 28 as stated being adapted to engage conduit 16 and a second end 30 being adapted to engage the open end of the motor vehicle exhaust pipe 32.

The second open end 34 of the conduit 16 may vent directly to the atmosphere or may releasably engage a vertically disposed after exhaust exit further conduit 36 that is adapted to exit the traveled exhaust fumes exterior to the garage 10 or at least away from the vehicle 12 where the same is not disposed in a garage 10. There is thus formed an elongated open ended exhaust system whereby once the vehicle engine is actuated, the exhaust fumes are not permitted to immediately vent to the atmosphere but are first channeled through the conduit 16 and only thereupon do they exit to the atmosphere. The foregoing taking advantage of the heat that is manifest in the exhaust fumes for de-icing of the driveway 14 surface. Of course, if desired, the final exit through conduit 36 may be merely adjacent the driveway and need not first be channeled back into the garage for exit therefrom. A supported vertical conduit can serve this purpose.

It is to be understood, that hot water or any other suitable fluid, liquid or gas can also be channeled through the conduit and system of the invention. It is preferably designed however, for use in conjunction with a motor vehicle, such as car, truck, motorcycle, etc.

Since it is obvious that numerous changes and modifications can be made in the above-described details without departing from the spirit and nature of the invention, it is to be understood that all such changes and modifications are included within the scope of the invention.

I claim:

1. In combination, a motor vehicle, a road surface for supporting said vehicle, a de-icing apparatus comprising an elongated hollow conduit embedded under said surface and having first and second open ends exterior said surface for receiving and discharging a flow of an exhaust gas therethrough, a first flexible conduit member open at each end thereof, one end communicating with the first end of said elongated conduit, the other end of said flexible conduit communicating with heated exhaust gas from said vehicle, said second end of said elongated conduit communicating with and venting said gas to the atmosphere whereby there is continuous fresh passage of said gas from said vehicle through said conduit to said atmosphere, a vertically disposed hollow conduit portion backstream of said second open end integral with said conduit and communicating with said second open end whereby said exhaust gas is vented above the source thereof.

2. An apparatus as defined in claim 1 wherein said hollow conduit is in the substantial shape of a coil or loop.

* * * * *